United States Patent [19]

Roman

[11] Patent Number: 5,024,180

[45] Date of Patent: Jun. 18, 1991

[54] STAMP AND ENVELOPE MOISTENER

[76] Inventor: Lorand J. Roman, 2734 Tech Ave., San Angelo, Tex. 76904

[21] Appl. No.: 488,936

[22] Filed: Mar. 5, 1990

[51] Int. Cl.[5] ..... B05C 1/02; B05C 1/08

[52] U.S. Cl. ..... 118/244; 29/121.2; 118/246; 118/248; 118/258

[58] Field of Search ..... 118/244, 248, 258, 246, 118/212, 121.4; 156/441.5, 442, DIG. 35, 578; 401/193, 208, 21; 29/121.4

[56] References Cited

U.S. PATENT DOCUMENTS

| | | | |
|---|---|---|---|
| 426,728 | 4/1890 | Maret | 156/441.5 |
| 1,117,387 | 11/1914 | Humphrey | 156/441.5 |
| 1,240,279 | 9/1917 | Wilson | 118/258 |
| 1,742,548 | 1/1930 | Leal | 118/258 |
| 2,465,941 | 3/1949 | Steen | 118/258 |
| 2,554,131 | 5/1951 | Vachon | 118/124 |
| 3,289,631 | 12/1966 | Vachon et al. | 118/244 |
| 4,364,157 | 12/1982 | Cutts | 118/212 |
| 4,744,688 | 5/1988 | Silber | 401/1 |
| 4,771,727 | 9/1988 | White et al. | 118/258 |

*Primary Examiner*—Michael G. Wityshyn

*Attorney, Agent, or Firm*—Fleit, Jacobson, Cohn, Price, Holman & Stern

[57] ABSTRACT

A moistener for stamps and envelopes is provided which includes a durable metal roller providing even water flow across the roller. The roller is made for continuous use with water for the purpose of moistening a layer of dried glue, which has been previously applied on envelopes, stamps, dried glued labels, and other materials which are used for adhesion in mail related objects. The roller includes a specific knurling pattern for a uniform flow of a thin layer of water across the roller. By the knurled pattern, a series of tiny water pockets are formed. Water transferred from a reservoir to the roller during rotation of the roller is held within these tiny pockets and the water, due to surface tension, extends between adjacent pockets and above diamond-shaped projections to produce a thin film of water protruding above the uppermost peripheral surface of the roller.

9 Claims, 2 Drawing Sheets

STAMP AND ENVELOPE MOISTENER

FIELD OF THE INVENTION

This invention relates to a moistener for stamps and envelopes and other products having a layer of dried glue.

BACKGROUND OF THE INVENTION

Prior attempts to apply water to a dried glue surface have included the use of a sponge located within a plastic dish which is shaped complementary to the sponge for storage of water. An alternate use of a sponge for application of water to a dried glue surface includes a sponge tip secured to a bottle or tube containing water for gravity flow of water to the sponge tip when in an inverted condition.

In both of these applicators, the dried glue surface is brought into direct pressure contact with the sponge for transfer of water contained within the sponge to the dried glue surface. Over time, due to the direct pressure contact of the dried glue surface with the sponge, the sponge becomes clogged with glue which is picked up by moving the dried glue surface across the sponge or moving the sponge tip across the surface of the dried glue. The glue cakes onto the sponge surface and ultimately forms an impermeable layer. The sponge applicator must then be discarded.

An alternate type of applicator is a porcelain roller moistener. A glazed porcelain roller is rotatably mounted within a water reservoir so that upon rolling of a dried glue surface across the porcelain roller, water is picked up from the reservoir and moves with the roller so as to apply water to the dried glue surface.

Approximately half the diameter of the porcelain roller projects above the uppermost surface of the reservoir. The water level in the reservoir must therefore be kept high by frequent fillings to obtain transfer of water from the reservoir to the roller. However, during rotation of the roller, a non-uniform amount of water is picked up by the roller leaving may open areas of exposure of the roller. The contact of the dried glue layer with the exposed porcelain roller causes transfer of the glue to the surface of the roller.

Again, as in the sponge applicator, a portion of the dried glue surface during each application, is imparted to the porcelain roller. Over time, the dried glue surface builds up and affects the efficiency of the porcelain roller.

SUMMARY OF THE INVENTION

It is therefore an object of the present invention to overcome the disadvantages of prior known moisteners.

The moistener of the present invention includes a durable metal roller made of "2024" aluminum providing even water flow across the roller. The roller is made for continuous use with water for the purpose of moistening a layer of dried glue, which has been previously applied on envelopes, stamps, labels, and other materials which are used for adhesion in mail related objects.

The roller includes a specific knurling pattern for a uniform flow of a thin layer of water across the roller. By the knurled pattern, a series of tiny water pockets are formed. Water transferred from a reservoir to the roller during rotation of the roller is held within these tiny pockets and the water, due to surface tension, extends between adjacent pockets and above diamond-shaped projections to produce a thin film of water protruding above the uppermost peripheral surface of the roller.

When an envelope or stamp or other dried glue surface is passed across the top of the roller, the dried glue surface contacts the roller to initiate rotation. A layer of water is picked up from a reservoir. The layer of water extends uniformly across and on the roller in a plane located above the surface of the roller. Due to the diameter of the roller and speed of rotation, the uniform layer of water across the roller imparts moisture to the entire dried glue layer as the roller rotates. The continued movement across the roller of the envelope or stamp causes activation of the glue at a point downstream from the roller and therefore moistened glue does not touch the knurled design of the roller. Due to a lack of contact of the dried glue in its activated state, the roller is maintenance-free and avoids a glue buildup.

The knurled pattern of the roller includes two sets of parallel extending grooves extending transverse to each other and forming an angle of 60° at an intersection of the sets of grooves along the longitudinal axis of the roller. Adjacent parallel grooves of each set are separated by approximately 1/32 inch. The diamond-shaped lands formed between the grooves facilitate the spreading of a uniform layer of water between adjacent pockets formed by the grooves so as to produce a water film above the surface of the roller. The depth of the grooves extends 0.010 to 0.015 inches. The diameter of the roller is approximately ¾ inch. A shaft extending through a central bore of the roller has a clearance of 0.007 inches for smooth rolling performance. The shaft is made of 300 series stainless steel to prevent corrosion. Due to the soft metal of the roller and the hard metal of the shaft, there is a minimum of wear on the roller.

The cup forming the reservoir for the roller is made from "2024" aluminum bar stock for durability and freedom from corrosion. A corrugated rubber layer on the bottom of the cup prevents slippage of the cup on any surface. The roller extends 1/16 inch above the uppermost surface of the cup to ensure contact of the dried glue surface with an uppermost circumferential portion of the roller which extends above the cup.

As an optional addition, a spring steel finger may be mounted on the uppermost edge of the reservoir cup and extend across the roller, preferably perpendicular to the roller, so as to provide a gap between the finger and the roller. A dried glue surface may be passed through the gap to ensure contact of the dried glue layer with the film of water extending above the roller to provide correct pressure on the dried glue surface towards the roller. A foam pad is located on a portion of the finger above the roller to contact an opposite surface of the material from the dried glue layer surface to bias the material towards the surface of the roller which includes a film of water extending above the roller.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
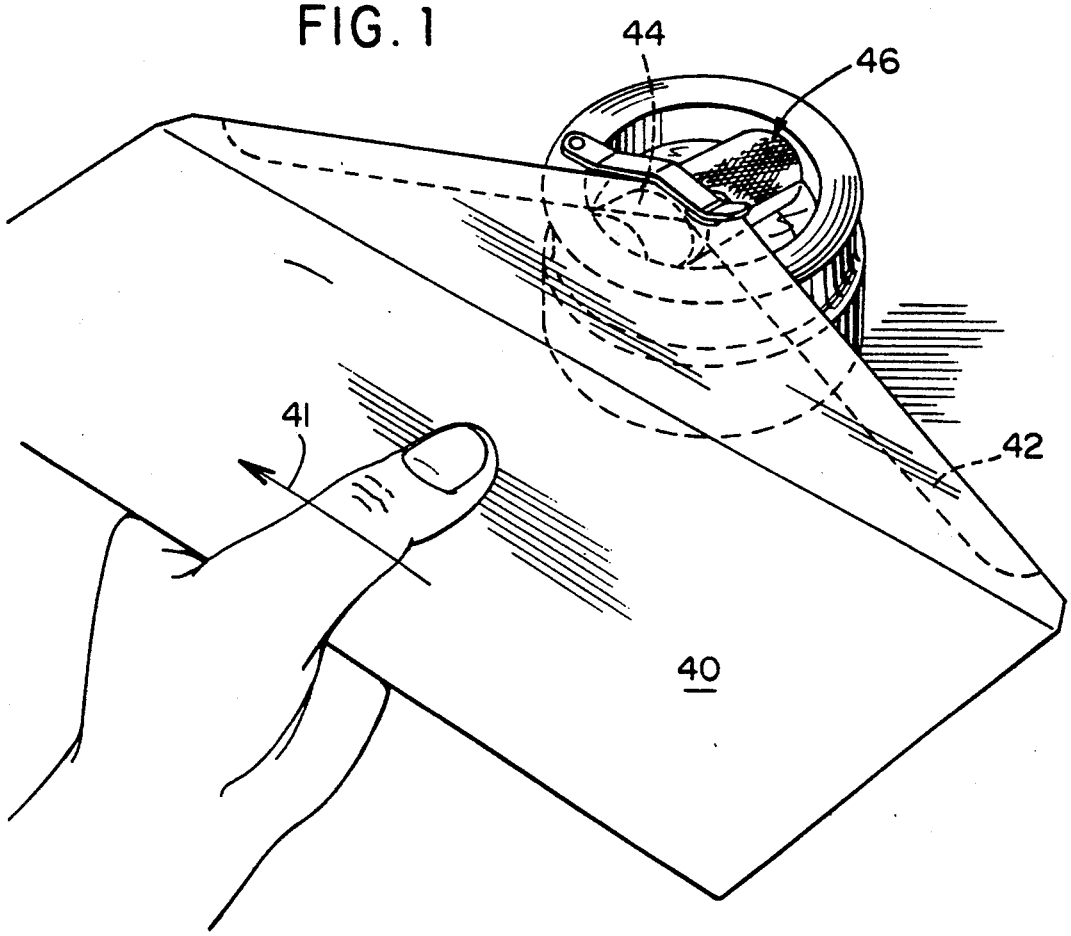
FIG. 1 illustrates use of the moistener of the present invention.
Figure 2:
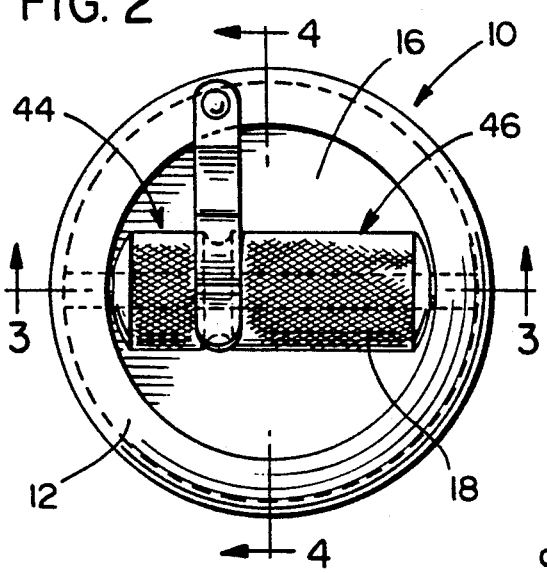
FIG. 2 is a top plan view of the moistener.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 2 through 6, in particular, a moistener embodying the teachings of the subject invention is generally designated as 10. The moistener 10 includes a cup 12 having a shaft 14 extending between opposite sides of the cup in openings 15 to span a reservoir 16 formed within the cup. A roller 18 is rotatably mounted on the shaft 14. The uppermost surface of the roller projects approximately 1/16 of an inch above the uppermost surface of the cup within which the roller is rotatably mounted. The reservoir 16 holds a supply of water 20 so that the roller 18 extends ⅓ to ½ its diameter into the water supply 20.

At the bottom of the cup 12 is a corrugated rubber layer 22 which prevents the cup from slipping when the cup is rested on a surface 24.

Figure 5:
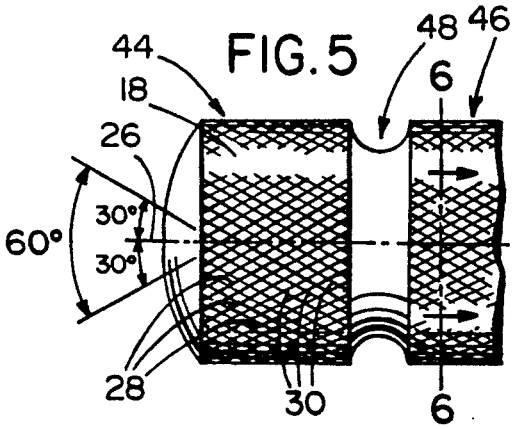
FIG. 5 illustrates the knurled surface pattern of the roller.

The roller 18 is approximately ¾ inch in diameter. Extending across the roller at an angle of 30 with respect to the longitudinal axis 26 of the roller 18 are a set of parallel grooves 28. Extending transverse to the set of grooves 28 and at an angle of 30° with respect to the longitudinal axis 26 of the roller 18 are a set of parallel grooves 30. The angle formed between the intersection of the grooves 28 and the grooves 30 is 60° as shown in FIG. 5. Each groove of each set of grooves is separated by a distance of 1/32 inch.

Figure 6:
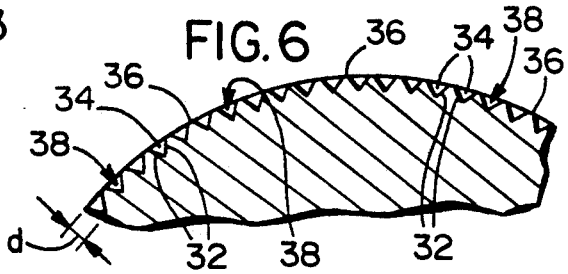
FIG. 6 is a sectional view taken along line 6—6 of FIG. 5.
Figure 3:
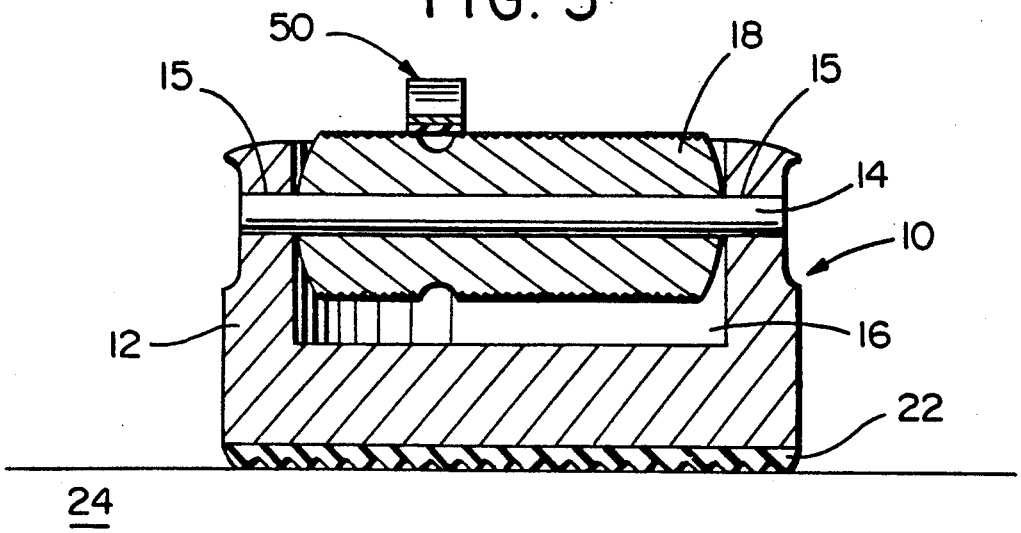
FIG. 3 is a sectional view taken along line 3—3 of FIG. 2.

The side walls 32 of the grooves 28 are shown in FIG. 6 with one side wall 34 of one groove 30 so as to define a plurality of diamond-shaped projections or lands 36. Defined between adjacent projections 36 are a plurality of pockets 38 defined by the side walls 32 of the grooves 28 and the side walls 34 of the groove 30. The depth of the pockets 38 is shown by "d" and at a depth of between 0.010 to 0.015 inches.

In FIG. 1, an illustrative application of the present invention is shown by moistening of a flap of an envelope 40 having a dried glue layer 42 extending along an edge of the envelope flap. When the dried glue layer is passed across a small width portion 44 of the roller, as compared to a larger width portion 46 of the roller which is used for stamps and labels, the roller is caused to turn. Due to the ¾ inch diameter of the roller, submerged ⅓ to ½ in the water 20 of the reservoir 16, a uniform thin film of water develops on the exterior peripheral surface of the roller. The force of surface tension on the water causes a bridging of the water in all of the pockets 38 so as to form a film of water above the roller. The continued movement of the flap of the envelope across the roller in the direction of arrow 41 turns the roller so as to have the film of water contact the dried glue layer without transfer of moistened glue to the surface of the roller. This prevents a transfer of glue to the roller which might eventually fill in the pockets of the roller and affect the efficiency of the moistener.

A groove 48 separates roller section 44 from roller section 46. The section 44 is dimensioned to accommodate a layer of dried glue on an envelope flap without having water contact other areas of the envelope flap. The groove 48 assures that only the area of the envelope flap having dried glue contacts the uniform water layer.

Of course, the width of the roller may be increased to accommodate different size labels or widths of layers of dried adhesive so as to accommodate all mailing needs. However, the diameter of the roller would remain approximately ¾ inch so that upon normal speed of rotation of the roller as an article to be mailed is moved across the film of water above the peripheral surface of the roller, a continuous film of water is maintained. If the diameter of the roller were increased, the ability of a film of water to be elevated from the reservoir to the uppermost surface of the roller would be hindered and affect the working efficiency of the roller.

Figure 4:
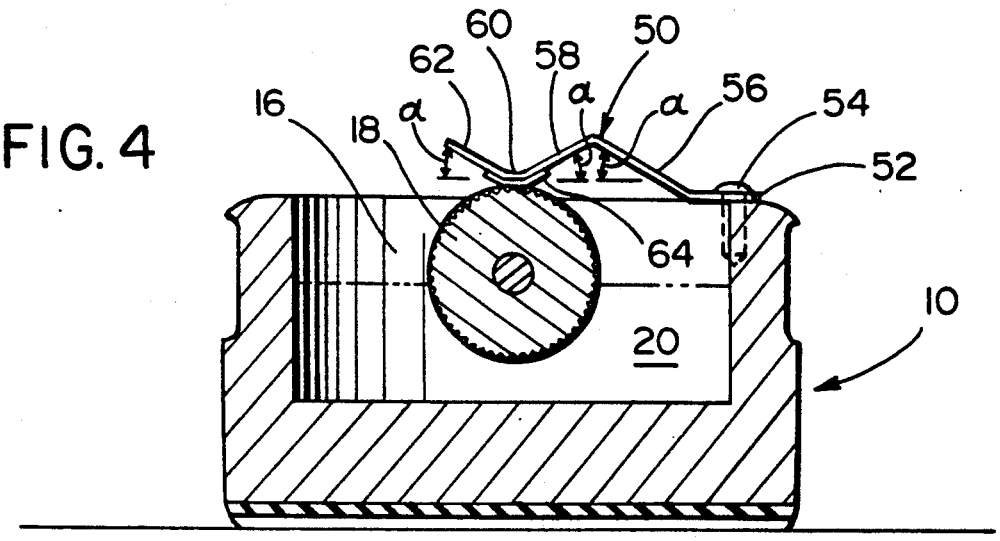
FIG. 4 is a sectional view taken along line 4—4 of FIG. 2.

In FIG. 4, an optional application finger 50 is shown secured to a side of the cup 12 by a rivet, screw or other type fastener 54 passing through a 5/32 diameter hole in a flat terminal portion 52 of the finger. The fastener 54 is secured in the cup 12 within a 6/32 tap hole, ¼ inch deep. The finger 50 is 1 ½ inches long and ¼ inch wide and made of 0.010 inch thick spring steel (45 R.C.). The location of the hole into which the fastener is secured is at a point ⅝ inch radially inward along the central longitudinal axis of the shaft 14, extending from an inner wall of the reservoir 16 defined by the cup 12 and at a location on the side wall of the cup 12 along a line extending perpendicular to the central longitudinal axis of the shaft 14.

An angled intermediate portion 56 extends from the flat terminal portion 52 at an angle $\alpha$ of 30°. An angled intermediate portion 58 extends from a flat intermediate portion 60 at an angle $\alpha$ equal to 30°. A terminal angled portion 62 extends from flat intermediate portion 60 at an angle $\alpha$ of 30°. Secured to the underside of the flat intermediate portion 60 and extending partially along angled intermediate portion 58 and angled terminal portion 62 is a foam pad 64, ¼ inch wide, 1/16 inch thick and ¾ inch long.

The finger 50 is pivotally mounted on the side of cup 12 to extend above the groove 48 which separates the portions 44 and 46 of the roller and is also positionable so as to extend above the portions 44 or 46. A gap measured between the bottom surface of the foam pad 64 and the uppermost surface of the roller 18 is sufficient to allow a film of water to be present on the uppermost surface of the roller and to pass a piece of paper having a dried glue layer in the gap so as to contact the film of water and rotate the roller while applying a predetermined pressure.

Figure 7:
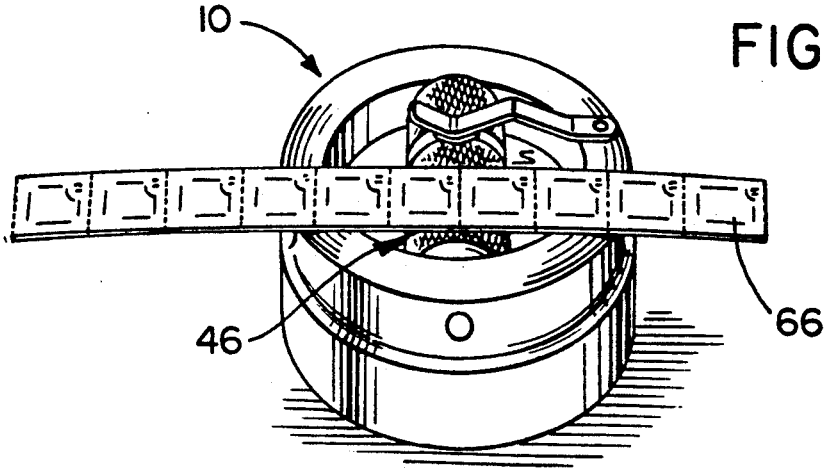
FIG. 7 illustrates the application of water to a strip of stamps using the moistener of the invention.

As shown in FIG. 7, a coil strip of stamps 66 is passed over the portion 46 of the roller so as to have a thin film of water, which is produced on the uppermost surface of the roller during rotation of the roller, transferred to the underside of the stamp 66 so as to moisten the dried glue layer.

By the operation of the present invention a uniform, thin film of water is produced on the uppermost surface of the knurled roller during rotation of the roller. A dried glue layer contacts the film of water without transfer of moistened glue to the roller due to the timing produced by rotation of the ¾ inch diameter roller within a reservoir of water. When the roller is rotated at a speed at which a piece of paper having a dried glue layer may normally be passed across the roller, a sufficient speed of rotation is produced to form a thin film of water across the uppermost surface of the roller. The dried glue layer is moved away from the surface of the roller after the moistening of the glue. Therefore, the moistener of the present invention is virtually maintenance free except for replenishment of water into the reservoir so as to maintain the depth of the roller at approximately ⅓ to ½ of its diameter within the reservoir of water.

A possible alternate material for the roller, however, maintaining the same specifications for the knurling of the roller include NYLOTRON or DELRIN or other plastic/nylon related materials which are capable of maintaining the knurled pattern described above.

Having described the invention, many modifications thereto will become apparent to those skilled in the art to which it pertains without deviation from the spirit of the invention as defined by the scope of the appended claims.

I claim:

1. A moistener for dried glue, said moistener comprising:

a cup, a reservoir defined by the cup, a shaft mounted in the cup and extending across the reservoir, a roller rotatably mounted on the shaft, said roller having a longitudinal axis, said roller including a knurled peripheral surface having raised diamond shaped projections formed by intersecting grooves, one set of parallel grooves being spaced approximately 1/32 inch apart and a second set of parallel grooves being spaced approximately 1/32 inch apart and extending transverse to said one set of grooves to form the intersecting grooves, said projections including two opposing corners defining an angle of 60° and two opposing corners defining an angle of 120°, said one set of grooves intersecting at an angle of 60° with respect to said second set of grooves and said one set and said second set intersecting the longitudinal axis of said roller at an angle of 30° and forming a plurality of pockets, said pockets formed by said one set and said second set of grooves being located between the projections so that a uniform film of water is formed across and above a peripheral surface of the roller during rotation of the roller through water held in the reservoir and applied directly to the dried glue of an article to be moistened.

2. A moistener as claimed in claim 1, wherein an uppermost portion of the peripheral surface of the roller projects above an uppermost surface of the cup by 1/16 inch.

3. A moistener as claimed in claim 1, wherein a finger extends from the cup over the roller to form a gap between the finger and the roller for receipt of material with a layer of dried glue.

4. A moistener as claimed in claim 3, wherein the finger includes a layer of foam above the roller.

5. A moistener as claimed in claim 4, wherein the finger is bent to define a space for passage of the material during application of water from the roller to the dried glue layer.

6. A moistener as claimed in claim 1, wherein means are located on a bottom of the cup for preventing slippage of the cup.

7. A moistener as claimed in claim 6, wherein the means is an elastic layer.

8. A moistener as claimed in claim 1, wherein the knurled peripheral surface is separated by a groove into two portions.

9. A moistener as claimed in claim 1, wherein said one set of grooves and said second set of grooves have a depth in the range of 0.010 to 0.015 inch.

* * * * *